United States Patent [19]

Ritter et al.

[11] Patent Number: 4,478,121

[45] Date of Patent: Oct. 23, 1984

[54] DIGITAL FEED SYSTEM

[75] Inventors: Frank Ritter, Baltimore; Romano Balordi, Millers, both of Md.

[73] Assignee: Maryland Cup Corporation, Owings Mill, Md.

[21] Appl. No.: 379,476

[22] Filed: May 18, 1982

[51] Int. Cl.[3] ..... B26D 5/20

[52] U.S. Cl. ..... 83/209; 83/241; 318/696

[58] Field of Search ..... 83/208, 209, 210, 211, 83/212, 241-243; 318/696

[56] References Cited

U.S. PATENT DOCUMENTS

| | | | |
|---|---|---|---|
| 3,229,556 | 1/1966 | Jensen | 83/211 X |
| 3,501,985 | 3/1970 | Baran | 83/97 X |
| 3,764,775 | 10/1973 | Hasslinger | 83/208 X |
| 3,805,138 | 4/1974 | Hilker | 318/696 |
| 3,927,587 | 12/1975 | Jackson et al. | 83/210 X |
| 3,967,518 | 7/1976 | Edwards | 83/210 |
| 4,056,024 | 11/1977 | Baert | 83/210 |
| 4,106,685 | 8/1978 | Strunc et al. | 83/208 X |
| 4,112,344 | 9/1978 | Klein | 318/696 X |
| 4,156,170 | 5/1979 | Strunc | 318/696 |

*Primary Examiner*—James M. Meister

*Attorney, Agent, or Firm*—McDougall, Hersh & Scott

[57] ABSTRACT

A stepping motor is used to feed sheet stock to a blank making assembly in a container making process. A translator provides necessary pulses to the stepping motor and is controlled by a counter which is provided with a pulse train indicative of the number of pulses provided the stepping motor. The contents of the counter compensate for the number of pulses necessary to stop the motor which will be produced by the translator. Alternatively, a print registration indicia may be sensed to initiate deceleration of the stepping motor. The indicia is offset a predetermined distance from a point of proper registration in order to compensate for the distance necessary to decelerate the stepping motor.

12 Claims, 3 Drawing Figures

DIGITAL FEED SYSTEM

FIELD OF THE INVENTION

This invention relates to a method and apparatus for feeding various types of sheet stock and more particularly, to a method and apparatus for feeding sheet stock in precise increments so that the stock may be accurately punched into container blanks of a desired shape.

BACKGROUND OF THE INVENTION

In the past, container blanks have been often formed by punching the blanks from sheet stock using, for example, a punch and die. While various methods were used to feed the sheet stock into the punch and die, accurate control of the length of feed was difficult and complicated. The difficulty of this problem was increased when the stock was printed so that the blanks had to be punched in registry with the printing.

This problem was sometimes overcome through the use of an auxiliary perforater on the printing press, which placed perforations on the feed stock in registry with the printing. The perforations were then used to register the printing on the stock. However, this system was complicated and required the use of special apparatus during the printing of the sheet stock as well as a compatable special apparatus to synchronize the container blanker to the perforations.

Alternatively, the prior art used complicated and costly crank arms, cams and followers to produce a feed system powered by the rest of the apparatus. This system exhibited problems in that the feed length could vary with machine speed. Also, it was difficult to change the feed length and precise registry was impossible.

OBJECT OF THE INVENTION

It is, therefore, an object of the present invention to provide a new and novel method and apparatus for feeding sheet stock to a punch or blanker in a precise manner.

It is another of the present invention to allow precise control of feed length in a system for feeding sheet stock into a blanker.

It is still another object of the present invention to precisely control the feed length of a feed system so that the blanking operation may be precisely synchronized to the location of printing on the sheet stock.

It is a further object of the present invention to digitally control the feed length of sheet stock into a blanker in order to more precisely control the feed length.

It is still a further object of the present invention to facilitate simple and inexpensive changes in the feed length of a feed system.

It is still a further object of the present invention to perform the above-stated objects in a container-making process in order to more precisely manufacture container blanks and accurately register the blanking operation to the location of printing on the sheet-stock.

These and other objects of the present invention will become more fully apparent with reference to the following specification and drawings which relate to the preferred embodiments with the present invention.

SUMMARY OF THE INVENTION

A convolute roll of elongated sheet stock such as polystyrene foam sheet is fed into a punch or blanker with precise control of the feed length. The feed of the sheet stock into the blanker is controlled electronically by application of pulses to a stepping motor. The drive circuit for the stepping motor monitors the number of pulses being applied to the stepping motor in order to control the feed length between individual blanking operations. The driving system includes a commercial type stepping motor translator for applying pulses to the stepping motor as well as a counter for monitoring the number of pulses applied. When the number of pulses applied to the stepping motor reaches a predetermined number stored in a counter, a signal is applied to the translator to initiate deceleration of the stepping motor. As the deceleration operation requires a predetermined number of pulses for completion, the predetermined number stored in the counter is less than the total number of pulses necessary to provide the desired feed length.

Alternatively, if the stock is printed, a colormark may be imprinted in relative registry to the position of each blank to be cut. A photoscanner senses the colormark and generates an output to signal the translator to begin the deceleration of the stepping motor. The predetermined distance necessary to decelerate the stepping motor under the control of the translator is conpensated for by shifting the photoscanner colormark relative to the printing on the sheet stock.

The digital feed system of the present invention further includes a tachometer which monitors the number of pulses per second produced by the translator in order to facilitate control of the pulse rate of the pulses supplied by the translator to the stepping motor.

DETAILED DESCRIPTION OF THE DRAWINGS

Figure 1:
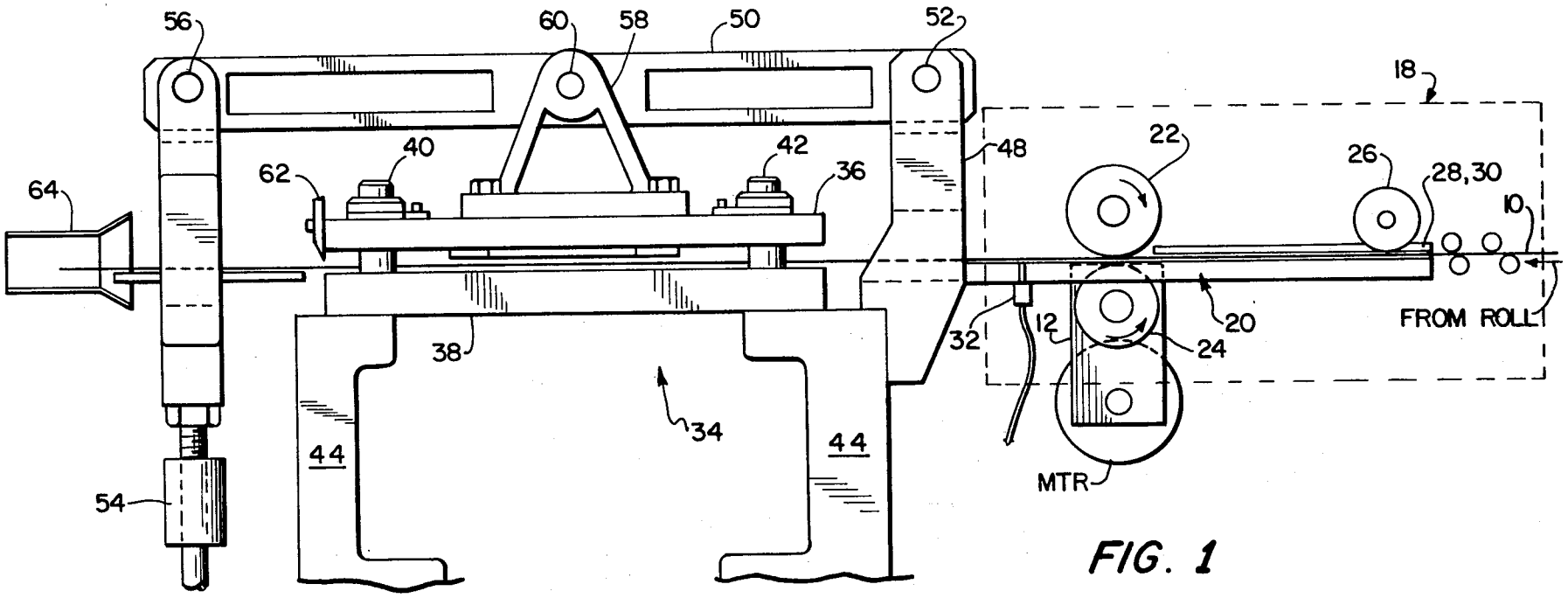
FIG. 1 is a side-sectional view of the sheet stock feed assembly and blanker of the present invention.
Figure 1A:
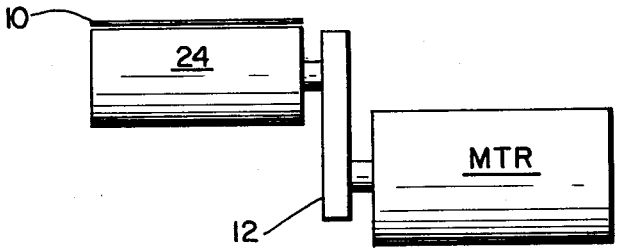
FIG. 1A is a schematic end view of the stepping motor and its relationship to the feed roller it drives.

Referring to FIGS. 1 and 1A, a sheet stock 10, such as foam, plastic or paper, is unwound from a supply roll (not shown) by a feed assembly 18. The feed assembly 18 of the present invention includes a feed table 20 for supporting the sheet stock 10. A driven feed roller 24 interacts with an idler feed roller 22 to strip the sheet stock 10 from the supply roll (not shown) as needed. The sheet stock 10 is then fed to a side-blanking die assembly 34 at a desired feed rate.

The feed assembly 18 further includes a guide roller 26 which guides the sheet stock 10 on the feed table 20. First and second adjustable guides 28, 30 constrain the sheet stock 10 for movement in the proper direction along the feed table 20.

A print-registration sensor 32 is provided in the feed assembly 18. This print-registration sensor 32 may, if desired, provide signals to the control of FIG. 2 to adjust the feed rate to properly register print provided on the sheet stock 10.

The side-blanking die assembly 34 includes a side-blanking punch 36 and an associated blanking-die 38. The side-blanking punch 36 and its associated die 38 may be formed of any desired construction. Alternatively, any form of blanking apparatus may be used with the digital feed system of the present invention. The side-blanking punch 36 is slidably mounted on punch-guide pins 40, 42. The associated blanking-die 38 is mounted to a die-support mount 44. A side-blanking punch fulcrum 48 is fixably mounted on the die support mount 44. A die-actuating arm 50 is pivotally mounted to the side-blanking punch fulcrum 48 on a fulcrum pin 52. The die-actuating arm 50 is reciprocated by an adjustable blanking-punch pushrod 54. The blanking-punch pushrod 54 is pivotally mounted on the die-actuating arm 50 through a pushrod pivot pin 56. The blanking-punch 36 has a blanking-punch bracket 58 attached thereto. The blanking-punch bracket 58 is pivotally mounted to the die-actuating arm 50 on a blanking-punch drivepin 60.

The blanking-punch pushrod 54 reciprocates in synchronism with the machine designed to utilize the finished blanks produced thereby. In the preferred embodiment, the blanking-punch pushrod 54 reciprocates in synchronism with the remainder of a cup-making apparatus which utilizes the blanks formed by the side blanking-die assembly or blanker 34 to produce finished disposable drinking cups. However, the feed system according to the present invention may be used with any blanker 34 for the production of blanks for use in any desired process.

With every reciprocation of the blanking-punch pushrod 54, the blanking-punch 36 is driven against its associated blanking-die 38 to punch a blank from the sheet stock 10. Simultaneously, a scrap-cutter 62 severs scraps from the remainder of the sheet stock 10. A vacuum scrap-removal channel 64 then removes the scrap from the blanking-die 34 for recycling. The completed blank is then used by the remainder of the apparatus, for example to form the sidewall of a cup in a cup making process.

Each time the blanking-punch pushrod 54 reciprocates to punch another blank, the sheet stock 10 must be advanced by the feed assembly 18 to provide new stock for the formation of a blank by the blanker 34. The sheet stock 10 is advanced by the pressure imparted between the driven feed roller 24 and idler feed roller 22. The driven feed roller 24 is driven by a stepping motor MTR via gear reducer 12. The relationship between the stepping motor MTR, gear reducer 12, and driven feed roller 24 may be seen in schematic in FIG. 1A.

Figure 2:
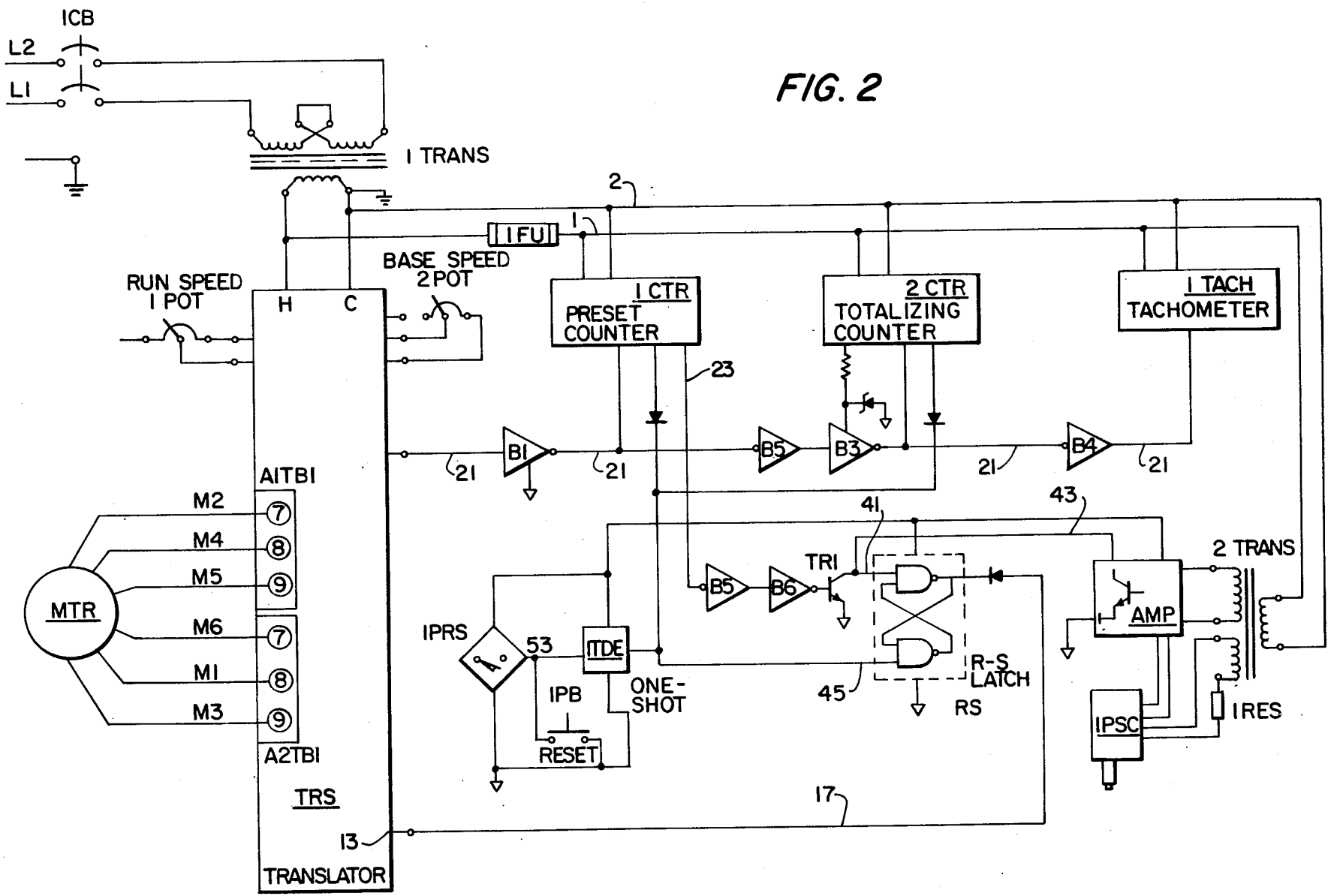
FIG. 2 is a circuit diagram of the control used to drive the feed assembly stepping motor.

The stepping motor MTR is driven and controlled by the circuitry of FIG. 2. Power is applied via power lines L1, L2 through a circuit breaker 1CB. The power is then applied to a main power transformer 1TRANS to reduce the power supply voltage to 115 V AC. This power is then applied to a translator TRS which applied pulses to the stepping motor MTR to thereby drive the motor. The translator TRS is a commercially available translator which produces the switching sequence needed to produce acceleration and deceleration pulse trains for changing the speed of the stepping motor MTR. In the preferred embodiment, a TM600 modular type translator manufactured by the Superior Electric Company, Bristol, Connecticut, is used to control the stepping motor. The translator TRS applies pulses to output lines M1–M6 which apply pulses to the stepping motor MRT to thereby drive the motor. The translator TRS contains an adjustable internal oscillator which controls the rotation of the stepping motor MTR. The oscillator controls internal logic which conditions the oscillator pulses to provide acceleration and deceleration characteristics to the motor. The driver circuitry produces pulses which energize the multiple windings of the motor in the proper sequence. The translator TRS further contains a power supply capable of producing low voltage-high current pulses necessary to drive the motor.

The stepping motor used in the feed system of the present invention is a direct current type motor. The armature rotates a precise angular increment for each digital pulse applied to the winding. The number of pulses applied in a given time frame determines the amount of shaft rotation and thus the feed length. Thus, by controlling the number of pulses applied to the stepping motor MTR, the feed length of the sheet stock 10 may be precisely controlled.

The translator TRS produces a pulse output on a pulse supply line 21 each time a pulse is provided to the stepping motor MTR. This pulse output is provided to a preset counter 1CTR, a totalizing counter 2CTR, and a tachometer 1TACH via the pulse supply line 21. A plurality of buffer amplifiers B1–B4 are used to insure the application of a correct pulse signal to each of the preset counter 1CTR, totalizing counter 2CTR, and tachometer 1TACH. Power is applied to the preset counter 1CTR, totalizing counter 2CTR, and tachometer 1TACH via power supply lines 1, 2.

The preset counter 1CTR contains a count therein representative of a desired number of pulses to be applied to the stepping motor MTR. The count stored within the preset counter 1CTR is less than the number of pulses to be provided to the stepping motor 1MTR as will be discussed later. Each time a pulse is produced on pulse output line 21, the contents of the preset counter 1CTR are decremented. When the contents of the counter reach zero, a signal is applied along a feed terminate line 23. This signal is applied to the base of a transistor TR1 via buffers B5 and B6. The emitter of transistor TR1 goes high to apply a signal to set inputs of RS latch RS. This causes the output of RS latch to go high to thereby provide a signal to a decelerate input 13 of the translator TRS via a latch output line 17. When the translator TRS senses a high signal on decelerate input 12, the translator begins to generate a decelerate sequence in order to decelerate the stepping motor MTR to a stop. As the decelerate sequence requires a predetermined number of pulses for its implementation, the contents of the preset counter 1CTR are less than the total number of steps required to produce the proper feed length out of the motor MTR. However, as the number of pulses necessary for a proper deceleration sequence is known, the contents of the preset counter 1CTR are simply adjusted to compensate for this factor.

Alternatively, the feed length of the digital feed system of the present invention may be controlled by sensing registration marks printed on the sheet stock during the printing process. A photosensor 1PSC receives power via power lines 1, 2 and a photosensing transformer 2TRANS. A photoamplifier AMP amplifies the signal produced by the photosensor and applies the signal via a photosensor line 43 to the set input 41 of RS latch RS. Thus, when the registration mark is sensed by the photosensor 1PSC, a signal indicative of the presence of the registration mark is generated and amplified by the photoamplifier AMP. This signal is then presented to the set input 41 or RS latch RS to produce a high signal at the output thereof to thereby produce a high signal at the decelerate input 12 to initiate the deceleration sequence as before. Again, a predetermined number of pulses will be generated during the deceleration sequence. However, the location of the registration mark on the sheet stock 10 relative to the printing thereon is adjusted to compensate for the number of pulses generated during the deceleration sequence.

The totalizing counter 2CTR is also connected to the pulse output of translator TRS via pulse supply line 21. The totalizing counter 2CTR counts the total number of pulses sent to the motor. The totalizing counter 2CTR includes a display for allowing the operator to view the number of pulses fed to the motor. The total number of pulses received by the stepping motor MTR is equal to the count within preset counter 1CTR plus the number of pulses supplied to the motor during the deceleration mode. Thus, the operator of the digital feed system of the present invention may adjust the predetermined number stored in preset counter 1CTR to vary the total feed length by monitoring the total feed length displayed by the totalizing counter 2CTR.

The operator of the digital feed system of the present invention may adjust the feed speed of the stepping motor MTR by adjustment of a run speed potentiometer 1POT and a base speed potentiometer 2POT which operates to adjust the run and inch speeds, respectively, of the stepping motor MTR. The speed of the stepping motor may be monitored by the operator by a tachometer 1TACH which is supplied pulses from the translator via pulse supply line 21. The tachometer indicates the pulses per second produced by the frequency translator TRS and is used in conjunction with the run speed potentiometer 1POT and base speed potentiometer 2POT to vary the speed rate of the digital feed system of the present invention.

After the sheet stock 10 is fed at a predetermined feed rate by the feed system of the present invention, the die actuating arm 50 is reciprocated by an adjustable blanking-punch pushrod 54 to actuate the side-blanking punch 36 of the side-blanking die assembly 34. Thus, a container blank is formed by the side-blanking die assembly 34. The blanking punch pushrod 54 reciprocates in synchronism with the machine designed to utilize the finished blanks produced thereby. During the operation of the side-blanking die assembly 34, a blanking operation switch 1PRS (schematically shown in FIG. 2) is actuated in order to time the digital feed system of the present invention to the remainder of the cup making machine. This blanking operation switch 1PRS provides a signal to a one shot time delay 1TDE. One shot time delay 1TDE produces a time delay sufficient to insure that the blanking operation is completed before a "high" logic level signal is produced at its output. This "high" logic level signal is provided on reset line 45 to simultaneously reset the RS latch RS, preset counter 1CTR and totalizing counter 2CTR.

The preset counter 1CTR, totalizing counter 2CTR, and tachometer 1TACH are commercially purchased units manufactured by Red Lion Controls. In the preferred embodiment, the preset counter 1CTR is a CA400P electronic presettable counter manufactured by Red Lion Controls of York, Pennsylvania. The totalizing counter 2CTR is a CA400T electronic totalizing counter manufactured by the same company while the tachometer 1TACH is a Ditak 11A digital tachometer and rate indicator manufactured by the same company.

SUMMARY OF OPERATION

To summarize the operation of the digital feed system of the present invention, sheet stock 10 is provided to a driven feed roller 24 which interacts with an idler feed roller 22 to strip the sheet stock from the supply roll. The driven feed roller 24 is driven by the stepping motor MTR via the gear reducer 12. The stepping motor MTR is driven by a commercially available stepping motor translator TRS which provides it with the proper pulse arrangements. The pulses provided by the translator TRS are provided to decrement a preset counter 1CTR in order to keep track of the feed length produced by the feed system of the present invention. When the contents of the preset counter 1CTR reach zero, a signal is applied along the feed terminate line 23 to set the RS latch RS and produce a signal on latch output line 17 to begin the deceleration of the stepping motor MTR by the translator TRS.

Simultaneously, the pulses produced by the translator TRS are counted by the totalizing counter 2CTR in order to produce a visual indication of the feed length produced by the stepping motor MTR. A predetermined number of pusles are necessary for the deceleration sequence, so the predetermined count stored in preset counters 1CTR is a predetermined number less than the total desired feed length. When the sheet stock 10 is completely fed by the feed system of the present invention, the number provided on the display of the totalizing counter 2CTR is indicative of the total feed length.

When the blanking punch 36 is driven against its associated blanking-die 38 to punch a blank from the sheet stock 10, a blanking operation switch 1PRS is actuated by the cup making machine. A predetermined time period later, the output of the one shot time delay 1TDE produces a logic "high" signal. This predetermined time delay produced by one shot time delay 1TDE is sufficient to insure that the blanking operation is completed before feeding of the sheet stock 10 is again started.

The "high" logic signal produced by the one shot time delay 1TDE serves to reset the preset counter 1CTR, the totalizing counter 2CTR, and the RS latch RS. This allows the output of the RS latch along latch output line 17 to again be logically "low". The removal of a "high" signal from the translator TRS signals the translator TRS to begin acceleration of the motor and repeat the feed sequence.

Alternatively, the feed system of the present invention may be used to run printed stock in registry. A photo-amplifier 1PFC senses the presence of color marks located on the preprinted sheet stock. When a color mark is sensed, a signal is amplified by amplifier AMP and provided to the RS latch RS via lines 43 and 41 to set the RS latch RS. This produces a "high" logic signal at the output of the RS latch RS to signal deceleration of the motor to translator TRS. A predetermined feed length later, the motor comes to a halt. As this predetermined feed length is known beforehand, the color marks are offset on the sheet stock a predetermined distance corresponding to the distance necessary to decelerate the stepping motor MTR.

The blanking operation is again performed and the blanking operation switch 1PRS actuated to reset the RS latch RS and again begin the feed sequence.

It is apparent from the discussion presented in this application that the digital feed system of the present application allows precise control of the feed length of sheet stock to a blanking operation. The invention being thus described, it will be readily apparent to one of ordinary skill in the art that the present invention can be modified in a number of ways. Such modifications are limited only by the scope of the appended claims.

What is claimed is:

1. A system for feeding sheet stock and making blanks therefrom comprising:

blanking means including a blanking punch and die for punching blanks from said sheet stock;

sensor means for developing a blanking signal indicative of operation of said blanking means;

a stepping motor;

sheet stock drive means driven by said stepping motor for feeding said sheet stock to said blanking means;

translator means for providing necessary drive pulses to said stepping motor, said translator means further producing a control output indicative of each said drive pulses; and counter means for monitoring the length of feed of said sheet stock by decrementing a count contained therein and for generating a stop motor signal a predetermined distance greater than zero before a desired feed length is reached, said predetermined distance allowing the stepper motor to decelerate to a stop at said desired feed length, said count being selected to represent said desired feed length minus said predetermined distance;

disable means being set by receipt of said stop motor signal for initiating a deceleration of said stepping motor by said translator;

time delay means responsive to said sensor means for producing a blank completion signal a predetermined time after receipt of said blanking signal, said predetermined time being sufficient to allow said blanking means to complete punching a said blank;

said blank completion signal resetting said counter means to said count and further resetting said disable means to enable said translator and restart said stepper motor;

said translator starting said stepper motor in response to resetting of said disable means.

2. The system of claim 1 wherein said sheet stock drive means feeds said sheet stock substantially without slippage.

3. The system of claim 1 wherein a predetermined number of pulses are supplied to said motor during in said predetermined distance;

said predetermined count stored in said counter means and said predetermined number of pulses during deceleration equal the total number of pulses necessary for the desired feed length.

4. The system of claim 3 wherein the feed length is directly related to the number of pulses supplied said motor.

5. The system of claims 1 or 3 wherein said blank making assembly forms cup blanks in a cup making process.

6. The system of claim 5 wherein said sheet stock is thermoplastic.

7. The system of claim 1 wherein said sheet stock has indicia printed thereon;

said sheet stock drive means feeding said sheet stock to said blanking means substantially without slippage;

said system further comprising photosensor means for detecting each said indicia and producing a sensed indicia output;

said disable means also being set by receipt of said sensed indicia output for initiating a deceleration of said stepping motor.

8. The system of claim 7 wherein said indicia are placed so that the number of pulses necessary to decelerate said motor after detection of one of said indicia will bring said printing into the proper position in relation to said blanking means.

9. The system of claim 8 wherein the feed length is directly related to the number of pulses supplied said motor.

10. The system of claim 8 wherein said blanking means forms cup blanks in a cup making process.

11. The system of claim 10 wherein said sheet stock is thermoplastic.

12. The system of claim 8 wherein said translation means is enabled after each operation of said blanking means making assembly.

* * * * *

UNITED STATES PATENT AND TRADEMARK OFFICE

CERTIFICATE OF CORRECTION

PATENT NO. : 4,478,121

DATED : October 23, 1984

INVENTOR(S) : Frank Ritter and Romano Balordi

It is certified that error appears in the above-identified patent and that said Letters Patent is hereby corrected as shown below:

Column 8, line 5 (Claim 3, line 2), after "during" insert --deceleration--.

Signed and Sealed this

*Tenth* Day of *September 1985*

[SEAL]

*Attest:*

DONALD J. QUIGG

*Attesting Officer* *Acting Commissioner of Patents and Trademarks - Designate*